US011826797B2

(12) United States Patent
McLeod

(10) Patent No.: US 11,826,797 B2
(45) Date of Patent: Nov. 28, 2023

(54) CLEARING DEVICE FOR REMOVAL OF SNOW OR ICE FROM A PIPE

(71) Applicant: James A. McLeod, Vassar (CA)

(72) Inventor: James A. McLeod, Vassar (CA)

( * ) Notice: Subject to any disclaimer, the term of this patent is extended or adjusted under 35 U.S.C. 154(b) by 152 days.

(21) Appl. No.: 17/342,022

(22) Filed: Jun. 8, 2021

(65) Prior Publication Data

US 2022/0008965 A1 Jan. 13, 2022

Related U.S. Application Data

(60) Provisional application No. 63/048,775, filed on Jul. 7, 2020.

(51) Int. Cl.

| | |
|---|---|
| ***B08B 7/00*** | (2006.01) |
| ***B08B 9/023*** | (2006.01) |
| ***B08B 5/02*** | (2006.01) |
| ***B08B 7/04*** | (2006.01) |

(52) U.S. Cl.

CPC ..... *B08B 7/0071* (2013.01); *B08B 5/02* (2013.01); *B08B 7/04* (2013.01); *B08B 9/023* (2013.01); *B08B 2205/00* (2013.01); *B08B 2209/02* (2013.01)

(58) Field of Classification Search

CPC ..... B08B 9/023

See application file for complete search history.

(56) References Cited

U.S. PATENT DOCUMENTS

| | | | | | |
|---|---|---|---|---|---|
| 1,740,663 | A | * | 12/1929 | MoManis | B08B 9/023 414/745.6 |
| 2,813,285 | A | * | 11/1957 | Aslin | B08B 9/023 292/256.65 |
| 2,820,561 | A | * | 1/1958 | Meagher | B66F 9/061 182/64.1 |
| 2,885,092 | A | * | 5/1959 | Orville | B66C 13/18 212/258 |
| 2,941,683 | A | * | 6/1960 | Fowler | B66F 9/061 414/607 |
| 3,007,592 | A | * | 11/1961 | Adams | B66F 9/061 414/607 |

(Continued)

FOREIGN PATENT DOCUMENTS

| | | | | | |
|---|---|---|---|---|---|
| CN | 110639896 | A | * | 1/2020 | B08B 9/023 |
| CN | 111701772 | A | * | 9/2020 | |

(Continued)

*Primary Examiner* — Spencer E. Bell
*Assistant Examiner* — Omair Chaudhri
(74) *Attorney, Agent, or Firm* — Ryan W. Dupuis; Kyle R. Satterthwaite; Ade & Company Inc.

(57) ABSTRACT

A pipe snow removal device is supported for movement longitudinally along a pipe to clear snow and/or ice from the pipe. A main housing has boundary walls defining an outer boundary of a bounded space within a hollow interior of the main housing. An inner boundary of the bounded space is open to the pipe upon which the main housing is supported. A mounting arrangement supports the main housing relative to a work vehicle that is movable alongside the pipe to displace the main housing along the pipe. A heater heats the bounded space to melt the snow/ice on the pipe. A scraper assembly supported in leading relationship to the main housing clears loose snow before melting remaining snow and ice on the pipe as the housing passes.

20 Claims, 4 Drawing Sheets

(56) References Cited

U.S. PATENT DOCUMENTS 3,096,886 A * 7/1963 Hall ..... B66C 23/36 212/238
3,109,541 A * 11/1963 Matson ..... B66C 13/18 212/253
3,415,339 A * 12/1968 Range ..... B66F 9/127 414/607
3,533,515 A * 10/1970 Milner, Jr. ..... F15B 15/06 212/245
3,587,893 A * 6/1971 Laken ..... B66F 9/061 414/640
3,598,347 A * 8/1971 Marburger ..... B23Q 9/00 248/654
3,685,673 A * 8/1972 Schweis ..... B60P 1/5428 414/547
3,759,399 A * 9/1973 Glass ..... B66C 1/22 212/347
3,762,588 A * 10/1973 Hansen ..... B66F 9/147 414/666
3,938,669 A * 2/1976 Vinton ..... B66C 13/18 212/196
3,994,766 A * 11/1976 Dedels ..... B08B 9/023 156/577
4,042,116 A * 8/1977 Bertolino ..... B62D 49/02 212/196
4,110,862 A * 9/1978 Buzhinsky ..... B08B 9/023 15/88
4,218,170 A * 8/1980 Goodacre ..... B66F 9/149 414/667
4,579,504 A * 4/1986 Lemme ..... B66F 9/061 414/607
4,666,049 A * 5/1987 Gilmore, Jr. ..... E02F 3/369 212/175
4,805,653 A * 2/1989 Krajicek ..... F28G 1/16 239/165
4,880,335 A * 11/1989 Lee ..... F16L 1/26 405/188
4,946,003 A * 8/1990 Walbridge ..... B66F 11/046 182/2.11
5,005,245 A * 4/1991 Dooley ..... B08B 9/023 15/104.04
5,069,234 A * 12/1991 Nielsen ..... B08B 9/023 451/92
5,085,016 A * 2/1992 Rose ..... B24C 3/32 451/92
5,092,357 A * 3/1992 Chapman ..... B08B 9/023 134/172
5,106,255 A * 4/1992 Motoda ..... B66C 23/44 212/277
5,615,696 A * 4/1997 Lawler ..... B08B 9/023 134/172
5,678,707 A * 10/1997 Stallbaumer ..... B66C 23/86 212/253
5,769,251 A * 6/1998 Wada ..... B66C 23/54 212/292
6,461,231 B1 * 10/2002 Taylor ..... B08B 9/023 451/92
6,523,221 B1 * 2/2003 Dahlin ..... B08B 9/08 15/345
8,454,295 B2 * 6/2013 Balcom ..... B66F 9/12 414/607
9,131,647 B1 * 9/2015 Lindberg ..... B66C 1/585
9,415,426 B1 * 8/2016 Blake ..... B08B 3/024
2006/0254998 A1 * 11/2006 Davis ..... F16L 1/06 212/238
2007/0240278 A1 * 10/2007 MacDonald ..... B08B 5/02 15/316.1
2008/0276828 A1 * 11/2008 Ornig ..... B61D 19/001 105/286
2009/0297275 A1 * 12/2009 Davis ..... F16L 1/028 212/258
2010/0212094 A1 * 8/2010 Cohen ..... B08B 9/023 15/104.04
2010/0294314 A1 * 11/2010 Daleside ..... B08B 9/023 134/21
2012/0241403 A1 * 9/2012 Ethington ..... B66C 23/66 212/281
2013/0098394 A1 * 4/2013 Fleischer-Pedersen ..... B63B 35/00 15/93.1
2013/0153303 A1 * 6/2013 Angelle ..... B08B 9/023 175/84
2013/0284541 A1 * 10/2013 Balcom ..... B66F 9/12 29/428
2017/0343308 A1 * 11/2017 Wojciechowski, III ..... F28G 15/02
2017/0361812 A1 * 12/2017 McCormick ..... B08B 3/02
2021/0229137 A1 * 7/2021 Van Voorhis ..... B05C 5/0241
2021/0269288 A1 * 9/2021 Hatch ..... B60P 1/5495
2021/0273424 A1 * 9/2021 Harvey ..... B66C 23/04

FOREIGN PATENT DOCUMENTS

FR 3033782 A1 * 9/2016 ..... B62B 3/0618
KR 102112012 B1 * 5/2020

* cited by examiner

CLEARING DEVICE FOR REMOVAL OF SNOW OR ICE FROM A PIPE

This application claims the benefit under 35 U.S.C. 119(e) of U.S. provisional application Ser. No. 63/048,775, filed Jul. 7, 2020.

FIELD OF THE INVENTION

The present invention relates to a pipe clearing device supported for movement along a pipe to heat the pipe, for example (i) to clear snow and/or ice from the pipe by melting and/or blowing the snow and/or ice away from the exterior of the pipe or (ii) to heat the pipe to increase flexibility of the pipe before bending the pipe to place the pipe in a trench, and more particularly the present invention relates to a pipe clearing device guided along the pipe by connection to a work vehicle that drives alongside the pipe.

BACKGROUND

The process of constructing a pipeline typically initially involves forming a trench in the ground along the intended path of the finished pipeline. Sections of pipe are assembled together to form a continuous pipeline above ground at a location alongside the intended path of the finished pipeline. Once the pipeline has been assembled above ground, it can be transferred laterally over and lowered into the trench, followed by backfilling of the trench to bury the pipeline. In colder climates, snow and ice may accumulate on the assembled pipeline while the pipeline remains supported on cribs alongside the trench, and this snow and ice must be removed before burying the pipeline in the trench.

Various devices are known for being supported along a pipeline to perform various maintenance tasks; however, no known devices are well suited for specifically clearing snow and ice from a pipe, nor are known devices well suited for being supported to ride along a pipeline without interference with various cribs upon which the pipeline is supported while remaining alongside the trench for assembly.

SUMMARY OF THE INVENTION

According to one aspect of the invention there is provided a pipe heating device for use with a work vehicle operable in a forward working direction alongside a frozen pipe, the device comprising:

- a main housing having boundary walls defining an outer boundary of a bounded space within a hollow interior of the main housing;
- the main housing being arranged to extend in a circumferential direction partway about a circumference of the pipe in a mounted position of the main housing on the pipe;
- an inner boundary of the bounded space within the hollow interior of the main housing being arranged to lie adjacent to the pipe in the mounted position;
- a mounting arrangement arranged to support the main housing relative to the vehicle such that the main housing is movable along the pipe in the forward working direction as the vehicle is displaced alongside the pipe in the mounted position of the main housing on the pipe; and
- at least one heating arrangement arranged to heat the bounded space within the main housing;
- the inner boundary of the bounded space being at least partly open to the adjacent pipe in the mounted position such that the bounded space heated by the heating arrangement is arranged to heat the pipe.

The heating arrangement may comprise (i) a burner arranged to combust a fuel to heat the bounded space, (ii) an electric heating element arranged to heat the bounded space, or (iii) various combinations of fuel burners and electric heating elements.

The heating arrangement may further include a heater arranged to generate a flow of heated air and a supply duct in communication between the heater and the bounded spaced within the hollow interior of the main housing so as to be arranged to direct the flow of heated air into the bounded space. The heater in this instance may be supported on the work vehicle or on the main housing.

The housing described above defines a bounded space that can be positioned to extend circumferentially about the pipe and that can be heated for effectively removing snow or ice from a pipe. The use of a mounting arrangement for connection to a separate work vehicle running alongside the pipe allows the housing to be efficiently supported on the pipe without any interference with any cribs upon which the pipe may be supported during assembly. The heated space about the pipe can also be used for heating a frozen pipe to increase the flexibility of the pipe prior to bending the pipe during placement into a trench.

The main housing may define a longitudinal axis extending between opposing front and rear ends in which the boundary walls of the main housing include an outer boundary wall that is partly cylindrical in shape about the longitudinal axis, having a radius which is greater than a radius of the pipe.

The boundary walls of the main housing may include a front boundary wall that is oriented perpendicularly to the longitudinal axis in which the front boundary wall extends radially inwardly to an inner edge which is semicircular in shape so as to be arranged to be supported in close proximity to the pipe in the mounting position.

The boundary walls of the main housing may also include a rear boundary wall that is oriented perpendicularly to the longitudinal axis in which the rear boundary wall extends radially inwardly to an inner edge which is semicircular in shape so as to be arranged to be supported in close proximity to the pipe in the mounting position.

Preferably a flexible skirt member spanning radially inwardly from the inner edge of the rear boundary wall so as to be arranged for sliding contact with the pipe in the mounted position.

The bounded space preferably extends in the circumferential direction between opposing ends of the bounded space which are located at laterally opposing sides of the main housing so as to be arranged to be located at laterally opposing sides of the pipe in the mounted position, in which the opposing ends of the bounded space are open to a bottom of the main housing.

Preferably a bottom edge of longitudinally opposed front and rear ends of the main housing are semicircular in shape and define a partly cylindrical shape of the inner boundary of the bounded space which extends between 160 and 180 degrees in the circumferential direction.

The device may include a plurality of guide wheels supported on the main housing so as to be arranged to support the main housing for rolling movement along the pipe in the mounted position. Preferably at least some of the guide wheels are supported on the main housing so as to be adjustable in a radial direction relative to the inner boundary of the bounded space of the main housing.

The device may further include a guide member supported at a bottom end of each one of a pair of laterally opposing sides of the main housing in which the guide members have bottom surfaces which extend laterally inwardly towards one another at an upward slope, and the guide members are laterally spaced apart from one another by a lateral distance which is approximately equal to a diameter of the pipe to receive the pipe therebetween in the mounted position of the main housing.

A scraper assembly may be supported on the main housing in which the scraper assembly comprises (i) a scraper body arranged to engage a top side of the pipe having an inner edge arranged to engage the top side of the pipe that is semi-circular in shape and that has a radius which is approximately equal to a radius of the pipe, and (ii) a suspension assembly supporting the scraper body at a front of the main housing such that the scraper body is movable in a radial direction relative to the main housing. A biasing arrangement is preferably operatively connected between the main housing and the scraper body such that the scraper body is biased into engagement with the pipe in the mounted position.

The device may further include a plurality of air nozzles supported on the main housing so as to be arranged to direct respective jets of air onto the pipe at circumferentially spaced apart positions about the pipe in the mounted position of the main housing on the pipe. The nozzles may be located (i) at the front leading side of the housing in place of or in addition to the scraper to clear loose snow and/or ice before heating, or (ii) at the rear trailing side of the housing for blowing away melted snow and/or ice to dry the pipe after heating by the bounded space.

The mounting arrangement may include a hoist arm arranged to be supported on the work vehicle to extend laterally outwardly from the work vehicle transversely to the forward working direction with the main housing being supported on the hoist arm, wherein the hoist arm is pivotal relative to the work vehicle about a horizontal lift axis such that an elevation of the main housing is adjusted with pivotal movement of the hoist arm about the lift axis.

The main housing may be suspended from the hoist arm using a flexible connection such that the main housing can be deflected laterally relative to the work vehicle as the work vehicle is displaced in the forward working direction alongside in the pipe.

The mounting arrangement may further comprise a vehicle adapter frame supporting the hoist arm thereon in which the vehicle adapter frame includes a pair of fork pockets formed therein which are arranged to receive lifting forks of the work vehicle therein so as to support the vehicle adapter frame on the work vehicle.

The hoist arm may be arranged to be supported relative to the work vehicle for pivotal movement about a vertical pivot axis such that the hoist arm is pivotal between a stored position oriented parallel to the forward working direction and a working position oriented to extend forwardly and laterally outwardly at a slope of between 35 and 55 degrees from the forward working direction in the mounted position of the main housing relative to the pipe.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
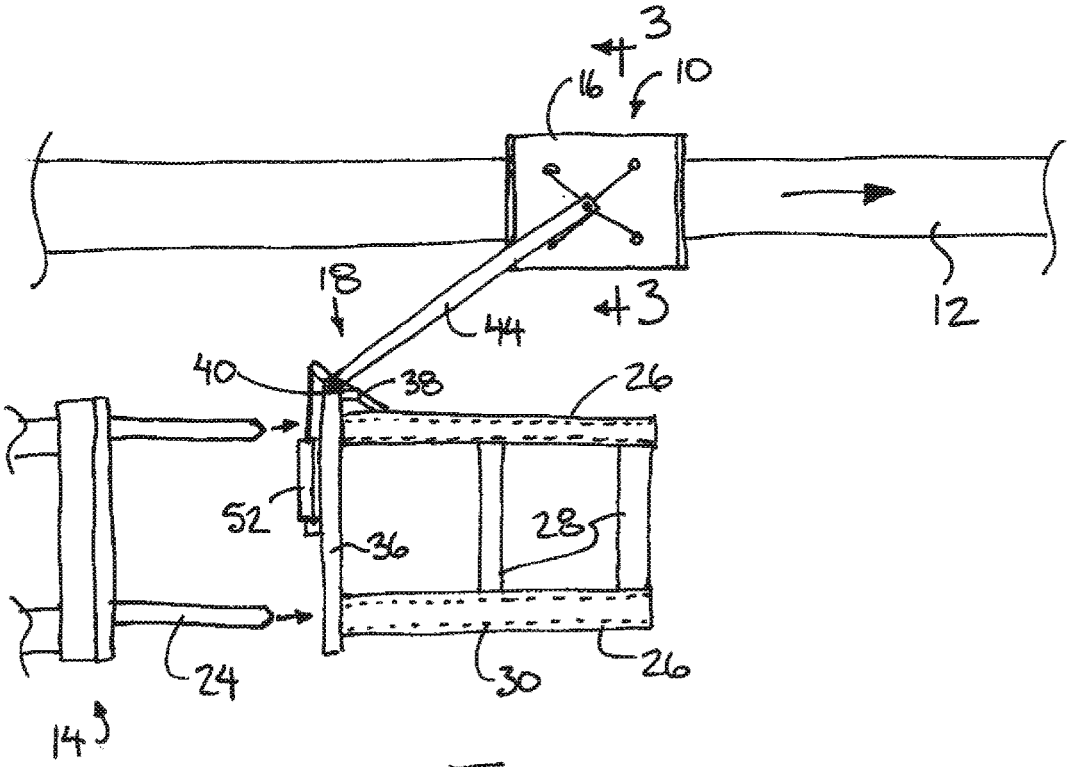
FIG. 1 is a top plan view of the pipe clearing device supported for movement alongside a pipeline.
Figure 2:
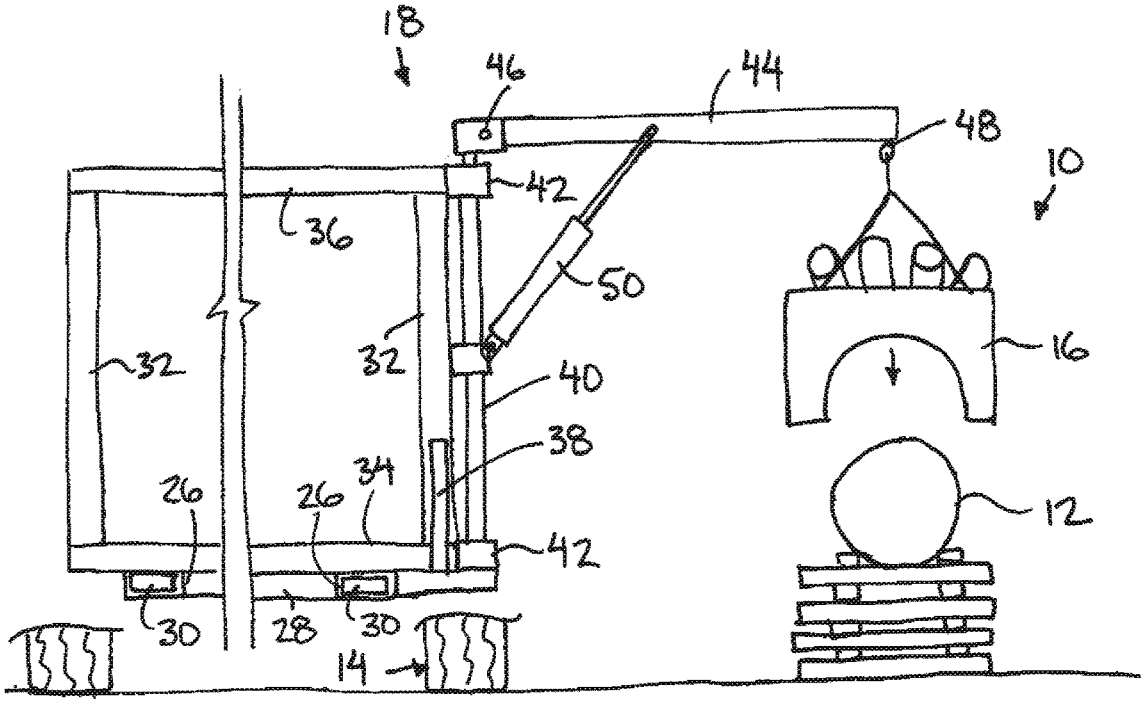
FIG. 2 is an end elevational view of the pipe clearing device relative to the pipeline.

Referring to the accompanying figures there is illustrated a pipe clearing device generally indicated by reference numeral 10. The device 10 is particularly suited for clearing snow and/or ice from a pipe 12, for example an assembled pipeline, by applying heat to the exterior of the pipe to melt the snow and/or ice.

The device 10 is particularly suited for working together with a work vehicle 14 that is operable for movement alongside a pipeline in a forward working direction of the vehicle that is parallel to the longitudinal axis of the pipe 12.

The device generally includes (i) a main housing 16 forming a bounded space within the hollow interior thereof which can be heated and which is open to the pipe in a mounted position of the housing relative to the pipe, (ii) a mounting arrangement 18 which supports the main housing relative to the vehicle 14 such that the main housing is movable along the pipe in the forward working direction as the vehicle is displaced alongside the pipe in the mounted position of the main housing on the pipe, and (iii) a heating arrangement including a heater 102 arranged to generate a flow of heated air and a supply duct 104 associated with the heater for communicating between the heater and the bounded space within the hollow interior of the main housing so as to be arranged to direct the flow of heated air from the heater into the bounded space and onto the pipe. The inner boundary of the bounded space within the hollow interior of the main housing is arranged to lie adjacent to the pipe in the mounted position while being at least partially open to the adjacent pipe such that the flow of heated air into the bounded space is directed onto the pipe.

In the illustrated embodiment, the mounting arrangement 18 is a vehicle adapter frame for cooperation with a work vehicle 14 of the type including lifting forks 24 which are suitable for being received within the pockets of a conventional pallet for example. More particularly, the work vehicle 14 in FIG. 1 comprises a loader having lift arms that support two lifting forks 24 on the lift arms for insertion into the pockets of the mounting arrangement 18.

In further embodiments, the work vehicle 14 may be any type of machine with a crane or boom. In this instance, the vehicle adapter frame merely serves as a connection between the main housing 16 and the existing crane or boom of the work vehicle such that the crane or boom of the work vehicle is used to position the main housing 16 laterally offset to one side of the work vehicle for alignment with the pipe as the work vehicle is displaced in the longitudinal direction of the pipe alongside the pipe.

In the illustrated embodiment, the vehicle adapter frame includes a lower frame portion lying in a generally horizontal plane at the bottom of the vehicle adapter frame. The lower frame portion is comprised of two horizontal beams 26 which extend longitudinally, which are parallel and spaced apart from one another, and which are connected by a plurality of crossbars 28 connected between the beams at longitudinally spaced positions therealong. The beams 26 comprise hollow tubes of rectangular cross-section which are open at opposing ends thereof to define pockets 30 suitable for receiving the lifting forks 24 therein respectively for carrying the vehicle adapter frame on the loader arms of the work vehicle.

The vehicle adapter frame further comprises an upright frame portion lying substantially in a vertical plane to extend upwardly from one end of the lower frame portion. The upright frame portion generally comprises two vertical posts 32 which are mounted parallel and spaced apart from one another at laterally opposing sides of the vehicle adapter frame. A lower beam 34 is connected horizontally between the bottom ends of the posts across the top of the beams 26 of the lower frame portion at one end thereof. Similarly, an upper beam 36 is connected horizontally between the top ends of the posts. An arrangement of angle braces 38 are connected between the lower frame portion and the upright frame portion to maintain the perpendicular relationship between the frame portions.

A pivot shaft 40 is supported vertically alongside one of the posts 32 of the upright frame portion to span substantially the full height of the upright frame portion. A pair of pivot couplings 42 support the pivot shaft rotatably relative to the vehicle adapter frame at vertically spaced apart positions along the pivot shaft.

A hoist arm 44 is supported to extend radially outward from a top end of the pivot shaft so as to span from an inner end 46 of the hoist arm pivotally coupled relative to the top end of the pivot shaft about a horizontal pivot axis therebetween, to an outer end 48 including a hook thereon from which the main housing 16 can be suspended. The hoist arm 44 pivots together with the pivot shaft to vary the angular orientation of the hoist arm relative to the forward working direction of the vehicle.

A lift actuator 50 is operatively connected between an intermediate location on the pivot shaft spaced below the hoist arm and a mounting location along the hoist arm space radially outward from the pivot shaft using pivotal couplings at opposing ends of the lift actuator. The lift actuator 50 is a hydraulic linear actuator including a piston received within a cylinder which can be extended and retracted in length for raising and lowering the outer end of the hoist arm relative to the end 46 pivotally coupled to the pivot shaft.

A pivot actuator 52 may also be operatively connected between a crank arm on the pivot shaft and the upper frame portion of the vehicle adapter frame. The pivot actuator is also a hydraulic linear actuator including a piston and cylinder cooperating together such that extension and retraction of the pivot actuator will pivot the crank arm with the pivot shaft about the upright pivot axis thereof relative to the vehicle adapter frame. In this manner the angular orientation of the hoist arm relative to the forward working direction can be controlled.

In some embodiments, the hoist arm can also be manually pivoted with the pivot shaft relative to the vehicle adapter frame.

Preferably the hoist arm can be pivoted from a stored position lying within a plane which is generally parallel to the forward working direction to a working position in which the hoist arm lies within a vertical plane oriented at approximately 45° from the forward working direction so that the hoist arm extends forwardly at a laterally outward slope to suspend the main housing spaced ahead of and laterally offset to one side of the work vehicle while being movable together with the work vehicle in the forward working direction alongside the pipe. Suspending the main housing 16 from the outer end of the hoist arm using a flexible connection such as a chain allows the lateral position of the main housing relative to the work vehicle to be slightly adjusted to accommodate minor variations in the lateral space between the work vehicle and the pipe as the work vehicle travels in the forward working direction alongside the pipe.

The main housing 16 comprises a plurality of boundary walls which surround a hollow interior of the housing so as to define the bounded space that partially surrounds the pipe in the mounted position of the main housing onto the pipe. The boundary walls include an outer boundary wall 54 which forms part of a cylinder in shape. More particularly the outer boundary wall is semicircular in profile to extend through an arc of at least 160 degrees and preferably approximately 180 degrees while extending in an axial direction substantially the full length of the housing between a front end 56 and a rear end 58. The radius of the outer boundary wall is greater than the radius of the pipe such that when the outer boundary wall of the main housing is supported concentrically with the pipe in the mounted position, a radial gap is defined between the outer boundary wall 54 of the main housing and the exterior of the pipe. This radial gap corresponds to the radial depth of the bounded space that is heated about the pipe in use.

The boundary walls of the main housing further include a front boundary wall 60 and a rear boundary wall 62 which are oriented perpendicularly to the longitudinal axis of the outer boundary wall 54 at the opposing front end 56 and rear end 58 thereof respectively. Each of the front and rear boundary walls extends generally radially inward from the respective end of the outer boundary wall 54 to a respective inner edge 64 which is semicircular in shape having a radius which is smaller than the radius of the outer boundary wall 54 but remains slightly larger than the radius of the pipe while being aligned concentrically with both such that in the mounted position a remaining clearance gap extends radially between the pipe and each of the inner edges 64 of the front boundary wall 60 and the rear boundary wall 62. The front boundary wall 60 encloses the front end of the bounded space by forming the front boundary thereof. Similarly, the rear boundary wall 62 encloses the rear end of the bounded space by forming the rear boundary thereof.

At the rear of the main housing 16, a gasket 66 is provided of flexible heat resistant material, for example rubber, which is mounted as a sheet parallel to the rear boundary wall so as to be substantially perpendicular to the longitudinal axis of the main housing. The gasket 66 is mounted to overlap the rear boundary wall 62 and to protrude radially inwards beyond the inner edge 64 of the rear boundary wall to a respective inner edge 68 of the gasket. The inner edge 68 of the gasket 66 is semicircular in shape and has a radius which closely approximates the radius of the pipe such that the inner edge 68 of the gasket is intended to form a close sliding contact with the exterior of the pipe in the mounted position. The gasket 66 thus spans the clearance gap between the inner edge 64 of the rear boundary wall 62 and the exterior of the pipe in the mounted position. The gasket 66 is mounted with threaded fasteners such that it can be readily replaced with a different gasket when it is worn, or to accommodate a different size of pipe. The gasket is thus available in different sizes such that the radius of curvature of the inner edge 68 of the gasket 66 can be closely matched to the radius of the pipe.

As described above, the bounded space within the hollow interior of the main housing extends generally in a circumferential direction between opposing ends 70 of the space lying at laterally opposing sides of the pipe in the mounted position. The bottom ends 70 of the bounded space at the laterally opposing sides of the housing remain open to the bottom to allow heated air within the housing to be exhausted through the bottom of the main housing together with any melted or partially melted snow and/or ice being cleared from the pipe.

A deflector 72 may be mounted along the bottom edge of the outer boundary wall 54 at both of the laterally opposing sides of the housing to extend generally in the longitudinal direction along the full length of the bounded space. More particularly, each deflector comprises a plate which is angled downwardly and inwardly towards the opposing side of the main housing for directing the exhausted flow exiting from the bottom of the bounded space of the housing inwardly below the pipe at each of the laterally opposing sides of the housing. The lateral distance between the bottom free edges of the laterally opposed deflectors 72 remains greater than the outer diameter of the pipe so as not to interfere with mounting of the housing onto the pipe by lowering the main housing downwardly over top of the pipe.

The inner boundary of the bounded space within the hollow interior of the main housing extends longitudinally between the inner edges 64 of the front and rear boundary walls 60 and 62 so as to be partly cylindrical in shape and so as to lie directly against the pipe in the mounted position of the housing on the pipe. The inner boundary remains fully open to the pipe across the full width in the circumferential direction and across the full length in the longitudinal direction of the housing. The inner boundary of the heated bounded space within the main housing is enclosed by the exterior wall of the pipe when the main housing is mounted onto the pipe.

A plurality of guide wheels 74 are mounted on the main housing 16 to serve to support the main housing on the pipe for rolling movement in the longitudinal direction in use. More particularly, a set of three guide wheels 74 are supported on each of the front boundary wall 60 and the rear boundary wall 62. Along each of the front and rear boundary walls, the respective set of guide wheels 74 are mounted at evenly spaced apart positions in the circumferential direction along the inner edge 64 such that the outermost pair of guide wheels on each boundary wall are approximately 180° apart. Lateral distance between inner surfaces of the outermost pair of guide wheels is approximately equal to the diameter of the pipe for receiving the pipe between the wheels in the mounted position of the housing on the pipe.

Each guide wheel 74 is supported on the respective boundary wall by a respective wheel frame 76. The wheel frame comprises a bracket with a first mounting flange 78 parallel to the forward working direction and parallel to a radial axis of the housing that is aligned with the respective guide wheel. A corresponding second mounting flange 80 is fixed onto the corresponding front or rear boundary wall with cooperating apertures therein that align with cooperating apertures in the first mounting flange 78. The apertures on one or both flanges are elongated in the radial direction such that fasteners can be used to fasten the mounting flanges in parallel abutment against one another at a plurality of different radial positions of the guide wheel relative to the inner edge of the boundary wall supporting the guide wheel thereon. In this manner, the guide wheels can be adjusted in a radial direction relative to the main housing and the pipe such that the inner surfaces of the set of guide wheels on each boundary wall can be aligned with one another along a common arc having a radius that is approximately equal to the radius of the pipe, thus enabling the position of the guide wheels to accommodate different pipe sizes having different radiuses.

To assist in guiding insertion of the pipe into the main housing as the main housing is lowered on top of the pipe in use, a set of guide members 82 are provided on the main housing. More particularly a set of two guide members 82 are provided on each of the front boundary wall and the rear boundary wall in which the two guide members are mounted at laterally opposing sides of the pipe opening that extends along a longitudinal axis through the main housing to receive the pipe therethrough. Each guide member 82 is formed of a rigid plastic material having a high molecular weight but which is softer than the material forming the pipe to prevent scratching of the pipe as the main housing is mounted onto the pipe. The two guide members on each of the front and rear boundary walls are mounted at opposing bottom ends of the inner edge 64 and have bottom edges 84 which are sloped to extend radially inwardly towards one another at an upward inclination. The guide members are laterally spaced apart from one another by a lateral distance which is approximately equal to a diameter of the pipe to receive the pipe therebetween in the mounted position of the main housing.

In this manner, as the main housing is lowered onto the pipe, any misalignment in the lateral direction of the pipe with the pipe opening through the housing causes the bottom edges 84 of the corresponding guide members along one side of the housing to engage the top of the pipe and urge the main housing to assume a concentric relation with the pipe as the main housing is further lowered into the mounted position. The radially innermost end of each bottom edge 84 is approximately aligned with the inner surface of a corresponding one of the guide wheels directly above the guide member 82.

The device 10 further includes a scraper assembly 86 supported on the main housing to engage the pipe at a location spaced forwardly of the front boundary wall 60 of the main housing. The scraper assembly 86 includes a scraper body 88 in the form of a rigid upright plate having a bottom edge 90 which is semicircular in shape and which includes a radius of curvature which is approximately equal to the radius of the pipe. At least the bottom edge of the scraper body 88 is formed of a rigid plastic material which is softer than the material forming the exterior of the pipe to minimize scratching of the exterior of the pipe.

The scraper body is supported on the forward ends of a pair of swing arms 92 which protrude forwardly from the front boundary wall 60 of the main housing in parallel relation to one another. Each swing arm is pivotally coupled at a rear end on a respective pivot coupling at the front boundary wall 60 of the main housing and supports the scraper body 88 in fixed relation to the front end thereof. The rear ends of the swing arms are mounted on the front boundary wall 60 at a location spaced above the inner edge 64 of the front boundary wall to extend generally forwardly at a downward slope towards the front ends of the swing arms supporting the scraper body 88 thereon such that the scraper body is near vertical in orientation in the mounted position of the main housing on a pipe with the bottom edge 90 of the scraper body in abutment with the pipe.

A pair of biasing springs 94 are operatively connected in between the front boundary wall of the main housing and the two swing arms 92 respectively. More particularly each biasing spring includes a rear end fixed to the front boundary wall 60 at a location spaced above the rear ends of the swing arms and a front end coupled to the corresponding swing arm 92 at an intermediate location therealong such that the spring is mounted under compression to generate a biasing force which biases the bottom edge 90 of the scraper body downwardly into engagement against the top side of the pipe. The pivotal support of the scraper body relative to the main housing allows the scraper body to be readily deflected upwardly over hard debris such as ice as the housing is displaced in the forward working direction along the pipe while being capable of pushing and wiping looser debris such as snow from the pipe before encountering the main housing.

A set of lift hooks 96 are fixed onto the top side of the main housing at the exterior of the outer boundary wall 54. In the illustrated embodiment, two lifting hooks 96 are laterally spaced apart at a position closer to the front end of the housing and two other lifting hooks 96 are laterally spaced apart closer to the rear end of the housing so that the set of four lifting hooks define corners of a rectangular shape which is substantially centred longitudinally and laterally relative to the housing. In this instance, a set of four lifting chains 98 are coupled to the four lifting hooks 96 respectively to extend upwardly and inwardly to one another to be joined together at a central lifting chain 100 which is then suspended from the hook at the end of the hoist arm 44.

Alternatively, two lifting hooks 96 could be used instead of the set of four hooks noted above by positioning the lifting hooks spaced longitudinally apart at laterally centered locations on the main housing.

Heat is provided to the bounded space within the main housing in the illustrated embodiment using a set of four heaters 102. Each heating arrangement or heater 102 comprises a supply duct 104 that communicates from an inlet end in communication with a source of heat to an outlet and joined to a respective opening communicating through the outer boundary wall 54 such that a flow of heated air is directed through the supply duct 104 from a heat source to the bounded space within the hollow interior of the main housing.

As further shown in the illustrated embodiment, each supply duct 104 comprises a short, rigid duct in the form of a 90° elbow that is oriented parallel to the forward working direction at the first end thereof and that is oriented radially in communication through the outer boundary wall 54 at the second end. In further embodiments, each supply duct 104 can be rotated about a radial axis relative to the main housing such that the first end of each duct 104 may be oriented tangentially to the main housing rather than parallel to the longitudinal direction as illustrated.

As illustrated, the heat source in this instance comprises a fuel burner 106, for example a liquid propane torch which combusts propane fuel directly at the first end of the elbow forming the supply duct 104. A blower 108 is in turn connected to the fuel burner 106 so as to be arranged to generate a flow of air drawn in from the surrounding atmosphere to be discharged through the fuel burner and into the supply duct 104.

Preferably the heaters 102 are staggered in relation to the outer boundary wall 54 such that each supply duct 104 communicates through the outer boundary wall at a respective distance from the front wall different from the other supply ducts at evenly spaced apart positions in the longitudinal or axial direction of the housing. The staggered arrangement of supply ducts includes a front pair of the ducts 104 closer to the front boundary wall which are laterally spaced apart from one another towards laterally opposing sides of the main housing. Similarly, the supply ducts include a rear pair of the ducts 104 closer to the rear boundary wall which are also laterally spaced apart from one another towards laterally opposing sides of the main housing. The supply ducts are thus spaced apart from one another in a suitable manner to direct a substantially even flow of heated air into the bounded space.

When the heaters 102 are supported directly on the main housing as described above, a fuel source for the heaters may be also supported on the main housing, or may alternatively be supported on the vehicle adapter frame. In the latter instance, fuel lines communicate between the vehicle adapter frame and the main housing by being suspended alongside the hoist arm 44 between the inner and outer ends thereof. Electrical power for the burners may be provided by a generator which can also be supported on the vehicle adapter frame such that electrical lines communicating between the generator and the burners are similarly supported along the hoist arm 44 between the vehicle adapter frame and the main housing.

In further arrangements, the heaters 102 may be replaced by a central heater supported on the vehicle adapter frame together with a fuel tank and a generator in which the common heater includes one or more burners combusting fuel to generate heat and one or more blowers generating a flow of heated air from the burners into a set of outlets. One outlet is associated with each of the supply ducts 104 such that the outlet communicates with the respective supply duct 104 by a flexible duct communicating laterally between the common heater on the vehicle adapter frame and the rigid supply duct 104 on the main housing 16.

When the common heater is a trailer type heater supported on wheels for rolling movement on the ground, the lower frame portion of the vehicle adapter frame is preferably sized to fit below the trailer heater between the wheels thereof such that the vehicle adapter frame can be raised to a height above the ground which suspends the wheels of the trailer heater from the lower frame portion of the vehicle adapter frame also to be spaced above the ground. The trailer heater can thus be entirely supported on the vehicle adapter frame on the work vehicle.

In use, the vehicle adapter frame is supported on the work vehicle, for example by inserting the lift forks on the loader arms of a loader into the lift pockets 30 in the lower frame portion of the vehicle adapter frame. The hoist arm can be actuated to connect to the central lift chain 100 of the main housing to lift the main housing from the ground to be carried on the vehicle adapter frame. The entirety of the pipe clearing device is thus movable together with the work vehicle.

When it is desired to deploy the main housing onto a pipe, the hoist arm is pivoted laterally outwardly from the vehicle adapter frame from a storage position with the hoist arm oriented in the forward working direction to the working position in which the hoist arm extends forwardly at a laterally outward slope of approximately 45° from the forward working direction. The outer end of the hoist arm can be lowered using the lift actuator 50 into the mounted position of the main housing 16 relative to the pipe. With the axial direction of the pipe opening through the main housing aligned with the longitudinal direction of the pipe, lowering of the main housing onto the pipe causes the bottom edges 84 of the guide members 82 to initially contact the pipe to properly align the main housing with the pipe in the lateral direction as the housing is continued to be lowered onto the pipe. Once the guide wheels engage the exterior of the pipe, the weight of the main housing can be carried directly on the pipe by the guide wheels. Alternatively a small or majority portion of the weight of the main housing can remain carried by the hoist arm with the guide wheels serving primarily to maintain alignment of the housing with the pipe.

To begin the process of clearing snow and/or ice from the pipe, the burners are ignited and the blowers are activated to generate a flow of heated air through the supply ducts and into the bounded space within the interior of the main housing. The flow of heated air is then directed circumferentially around the pipe. The gasket at the rear boundary wall substantially prevents escape of heated air at the rear boundary of the bounded space. The absence of a gasket at the inner edge 64 of the front boundary wall 60 allows a portion of the heated air to be exhausted through the front gap which has a preheating effect to heat debris on the pipe as the housing is advanced in the forward working direction along the pipe. A substantial portion of the heated flow of air that is directed into the bounded space of the housing is exhausted through the bottom openings at laterally opposing sides of the housing.

As the housing is displaced forwardly along the pipe, the engagement of the scraper assembly with the pipe clears any loose snow or ice while the heated flow of air within the housing provides sufficient heat to melt or loosen any remaining ice clinging to the exterior of the pipe. The mechanical wiping of the exterior surface of the pipe by the gasket at the rear wall provides a final opportunity to clear any remaining debris from the exterior surface of the pipe as the main housing 16 is displaced along the pipe.

Figure 4:
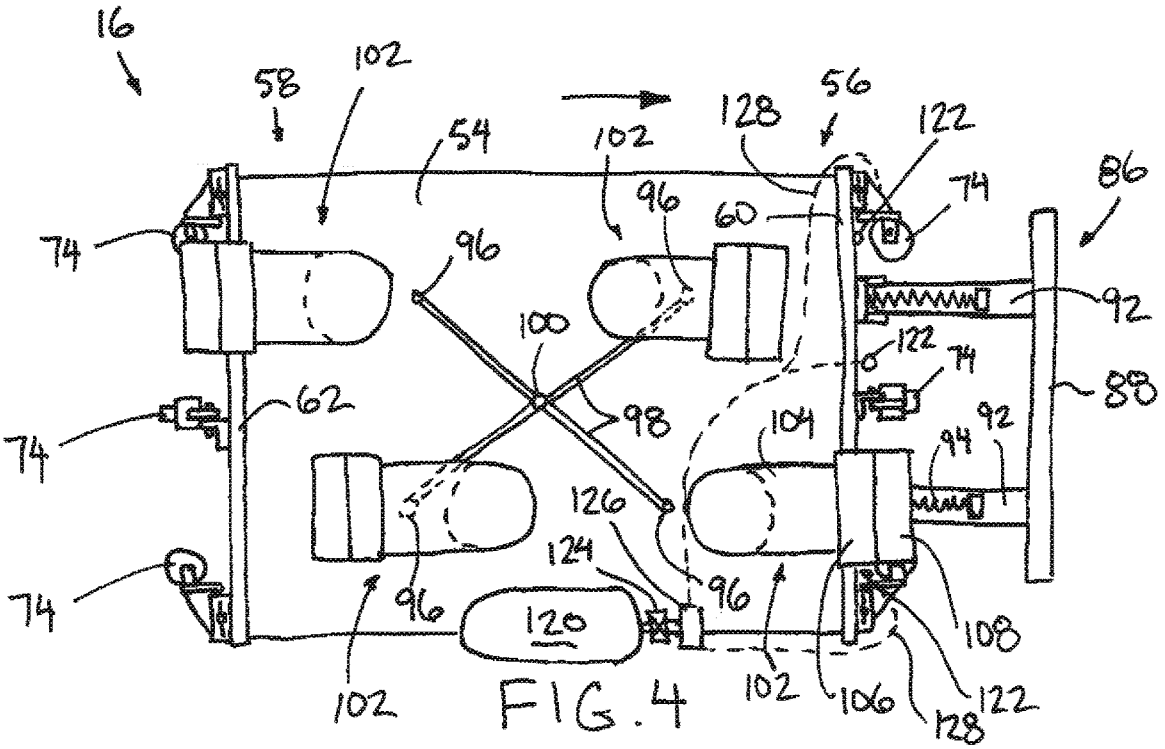
FIG. 4 is a top plan view of the main housing of the pipe clearing device.
Figure 5:
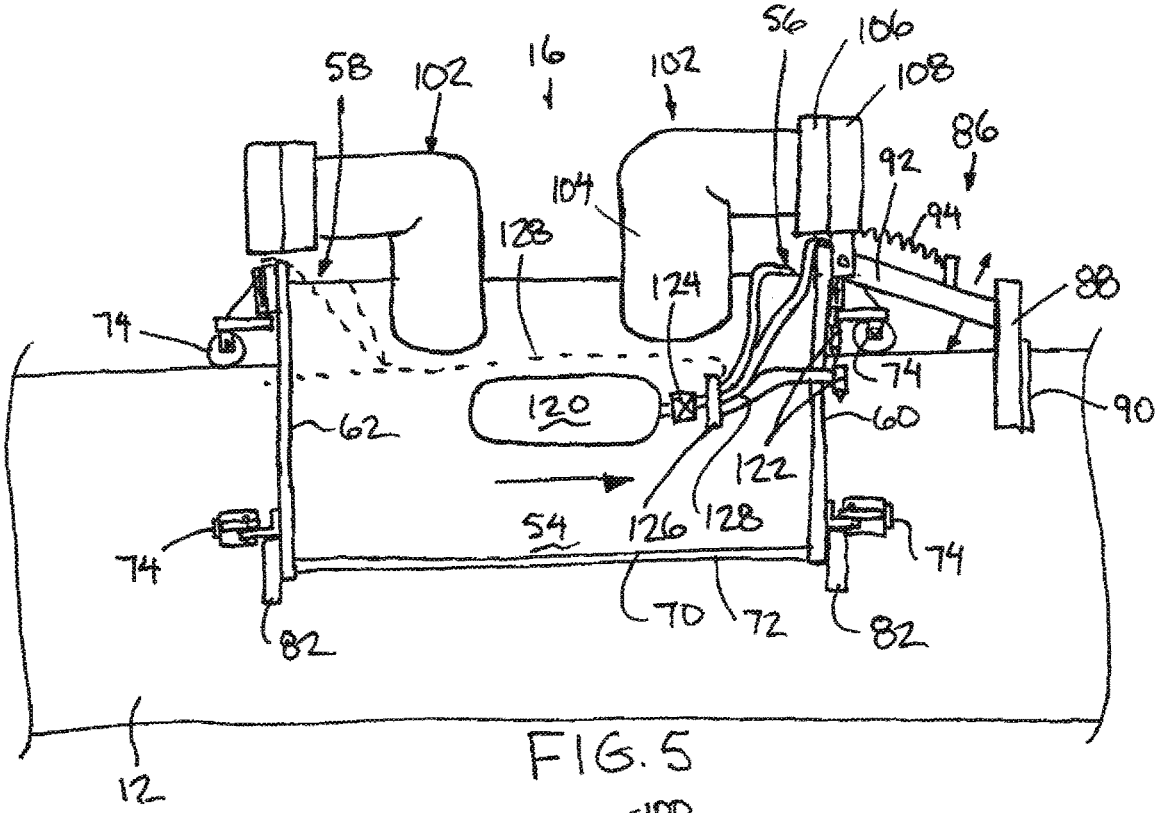
FIG. 5 is a side elevational view of the main housing of the pipe clearing device supported on a pipe.
Figure 6:
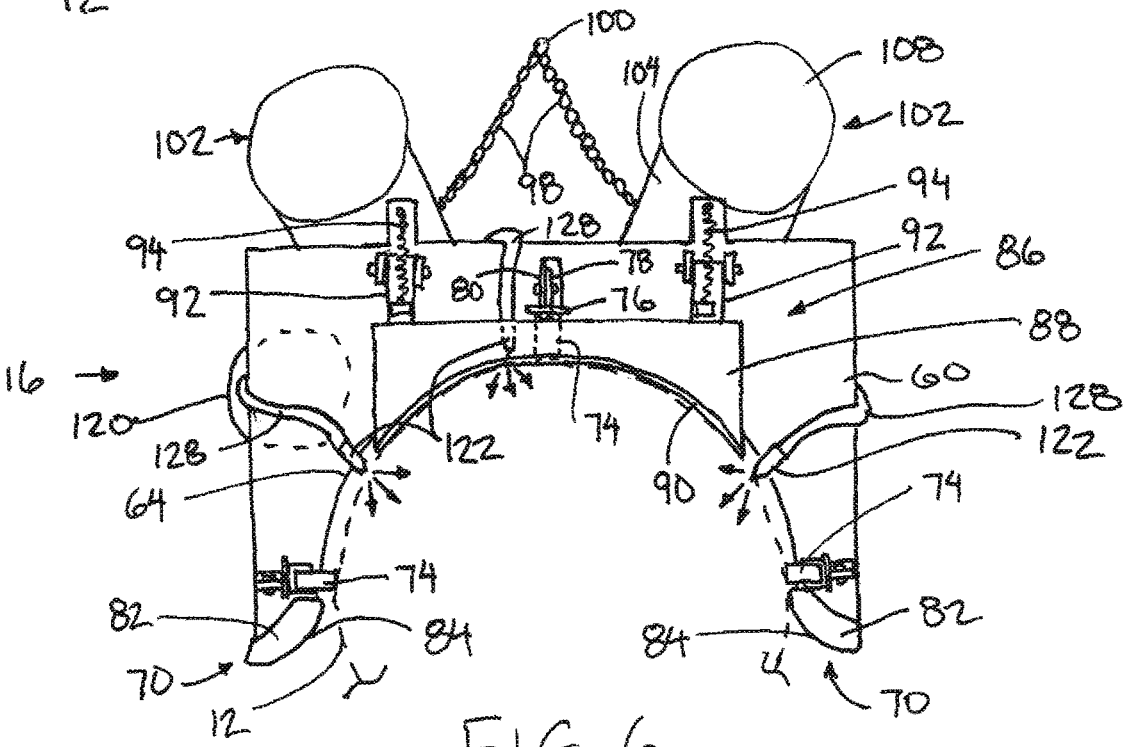
FIG. 6 is a front end elevational view of the main housing of the pipe clearing device.
Figure 7:
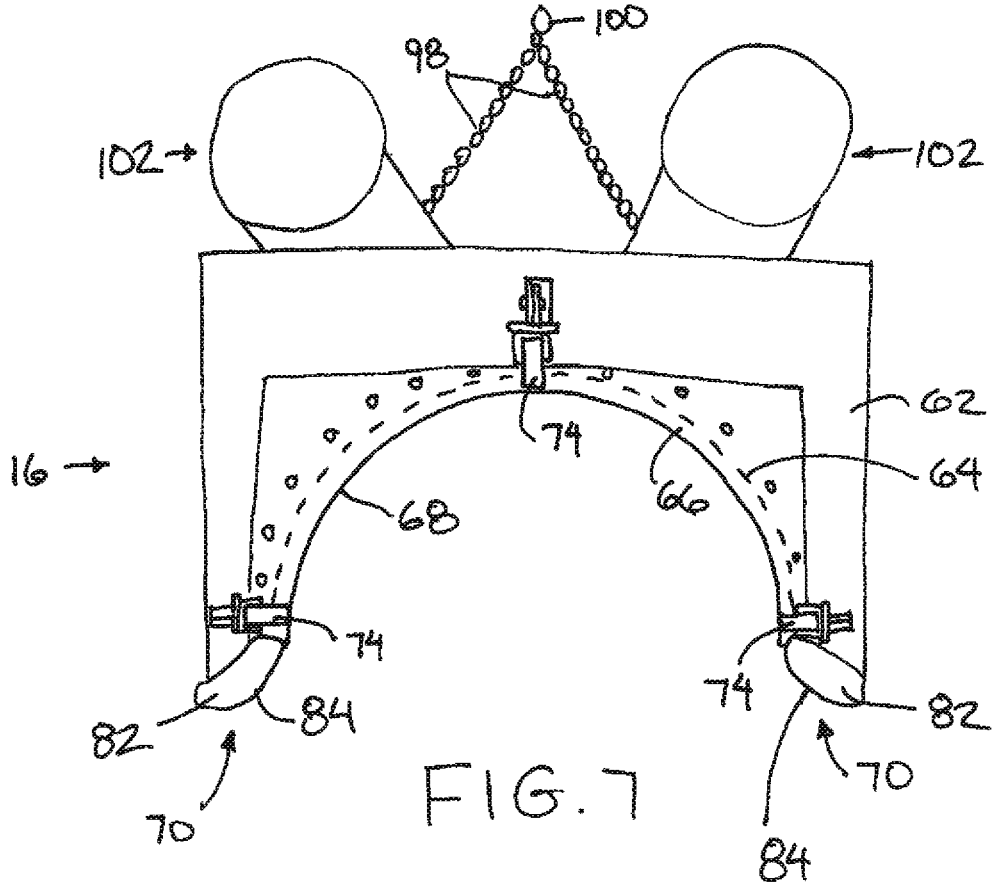
FIG. 7 is a rear end elevational view of the main housing of the pipe clearing device.

As best shown in FIGS. 4 through 6, the device may further include a compressed air source 120 to provide a flow of compressed air to a plurality of air nozzles 122 mounted on the housing. In preferred embodiment, the compressed air source 120 may be a compressor mounted on the vehicle adapter frame to supply a continuous supply of compressed air, however the compressed air source 120 may also take the form of a tank mounted on the housing. The source 120 is connected to a supply valve 124 to control the release of air to a manifold 126 which in turn directs a high-pressure flow of air through a plurality of supply lines 128 to the nozzles 122 respectively. The nozzles 122 direct respective jets of air onto the pipe at circumferentially spaced apart positions about the pipe in the mounted position of the main housing on the pipe. The nozzles 122 may be evenly spaced apart locations in the circumferential direction along one or both of the front leading edge at the front boundary of the bounded space or the rear trailing edge at the rear boundary of the bounded space. When provided at the leading side, the nozzles 122 may replace the scraper or work together with the scraper to clear loose material from the pipe before heating by the bounded space. When provided at the trailing side, the nozzles 122 assist in clearing away melted or partly-melted snow and ice to dry the pipe after heating by the bounded space.

Figure 3:
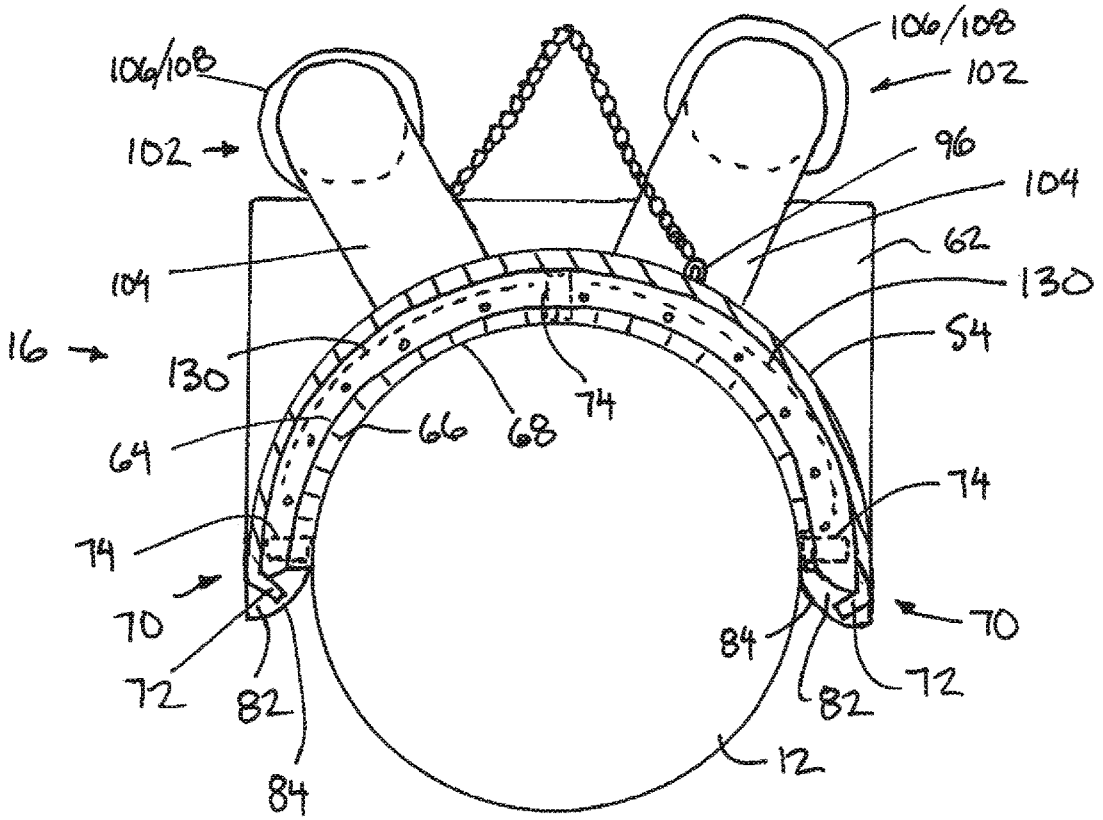
FIG. 3 is a sectional end view of the main housing of the pipe clearing device along the line 3-3 in FIG. 1.

The device 10 may also include electric heating elements 130 within the bounded space as represented schematically in FIG. 3. The heating elements 130 can receive electrical power through flexible power lines connected between the heating elements 130 and a suitable generated supported on the vehicle mounting frame to be carried on the vehicle. The heating elements 130 can be used on their own, independent of the burners 106 to heat the bounded space and in turn heat the pipe, or alternatively the heating elements 130 can be used to provide additional heat supplementary to the burners 106.

In further embodiments, the heaters 106 connected to the supply ducts 104 may comprise electric heating elements instead of fuel combusting burners as described above. In this instance, the electric heaters 106 would cooperate with blowers 108 as described above to generate a flow of heated air directed through the supply ducts 104 into the bounded space to heat the bounded space and thereby heat the pipe as described above.

The pipe clearing device 10 is particularly suited for clearing and/or heating pipe sections of a pipeline which is supported alongside a trench during assembly of the pipeline immediately prior to bending of the pipeline to lay the pipeline into the trench.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A pipe heating device for use with a work vehicle operable in a forward working direction alongside a frozen pipe, the device comprising:

a main housing defining a longitudinal axis extending between opposing front and rear ends of the main housing and having a plurality of boundary walls defining an outer boundary of a bounded space within a hollow interior of the main housing;

the main housing extending in a circumferential direction only partway about the longitudinal axis of the main housing, and the main housing being arranged to be mounted concentrically with the pipe in a mounted position of the main housing on the pipe;

an inner boundary of the bounded space within the hollow interior of the main housing being arranged to lie adjacent to the pipe in the mounted position;

a mounting member arranged to connect the main housing to the work vehicle such that the main housing is movable along the pipe in the forward working direction together with the work vehicle as the work vehicle is displaced alongside the pipe in the mounted position of the main housing on the pipe;

and at least one heater arranged to heat the bounded space within the main housing in which the heater is arranged to generate a flow of heated air directed into the bounded spaced within the hollow interior of the main housing;

wherein the inner boundary of the bounded space is at least partly open to the adjacent pipe in the mounted position such that the bounded space heated by the heater is arranged to heat the pipe;

wherein the bounded space only extends in the circumferential direction between laterally opposing ends of the bounded space which are located at laterally opposing sides of the main housing so as to be arranged to be located at laterally opposing sides of the pipe in the mounted position; and wherein the opposing ends of the bounded space are open to a bottom of the main housing so as to be arranged to exhaust the flow of heated air from the bounded space at the laterally opposing sides of the main housing through the open opposing ends of the bounded space in the mounted position of the main housing on the pipe, corresponding to the flow of heated air being exhausted from the bounded space at the laterally opposing sides of the pipe.

2. The device according to claim 1 wherein the plurality of boundary walls of the main housing includes an outer boundary wall that is partly cylindrical in shape about the longitudinal axis, having a radius which is greater than a radius of the pipe.

3. The device according to claim 1 wherein the plurality of boundary walls of the main housing includes a front boundary wall that is oriented perpendicularly to the longitudinal axis, the front boundary wall extending radially inwardly to an inner edge which is semicircular in shape so as to be arranged to be supported in close proximity to the pipe in the mounting position.

4. The device according to claim 1 wherein the plurality of boundary walls of the main housing includes a rear boundary wall that is oriented perpendicularly to the longitudinal axis, the rear boundary wall extending radially inwardly to an inner edge which is semicircular in shape so as to be arranged to be supported in close proximity to the pipe in the mounting position.

5. The device according to claim 4 further comprising a flexible gasket spanning radially inwardly from the inner edge of the rear boundary wall so as to be arranged for sliding contact with the pipe in the mounted position.

6. The device according to claim 1 further comprising a pair of deflectors mounted at the laterally opposing ends of the bounded space respectively, each deflector extending in a direction of the longitudinal axis and being sloped downwardly and inwardly towards the laterally opposing side of the main housing so as to be arranged to direct the flow of heated air exhausted from the bounded space of the main housing inwardly below the pipe.

7. The device according to claim 1 wherein a bottom edge of longitudinally opposed front and rear ends of the main housing are semicircular in shape and define a partly cylindrical shape of the inner boundary of the bounded space which extends between 160 and 180 degrees in the circumferential direction between the opposing ends of the bounded space.

8. The device according to claim 1 further comprising a plurality of guide wheels supported on the main housing so as to be arranged to support the main housing for rolling movement along the pipe in the mounted position.

9. The device according to claim 1 wherein at least some of the guide wheels are supported on the main housing so as to be adjustable in a radial direction relative to the inner boundary of the bounded space of the main housing.

10. The device according to claim 1 further comprising at least one guide member supported at a bottom end of each one of the laterally opposing sides of the main housing, the guide members having bottom surfaces which extend laterally inwardly towards one another at an upward slope, and the guide members being laterally spaced apart from one another by a lateral distance which is approximately equal to a diameter of the pipe to receive the pipe therebetween in the mounted position of the main housing.

11. The device according to claim 1 further comprising a scraper assembly supported on the main housing, the scraper assembly comprising:

a scraper body arranged to engage a top side of the pipe, the scraper body having an inner edge arranged to engage the top side of the pipe, the inner edge being semi-circular in shape and having a radius of curvature which is equal to a radius of the pipe, in which at least the inner edge of the scraper body is formed of a rigid, plastic material; and a suspension assembly supporting the scraper body at a front of the main housing such that the scraper body is movable in a radial direction relative to the main housing.

12. The device according to claim 11 further comprising a biasing member operatively connected between the main housing and the scraper body such that the scraper body is biased into engagement with the pipe in the mounted position.

13. The device according to claim 1 further comprising a plurality of air nozzles supported on the main housing at a front of the housing so as to be arranged to direct respective jets of air onto the pipe at circumferentially spaced apart positions about the pipe in the mounted position of the main housing on the pipe.

14. The device according to claim 1 further comprising a hoist arm arranged to be supported on the work vehicle to extend laterally outwardly from the work vehicle transversely to the forward working direction, the main housing being supported on the hoist arm, wherein the hoist arm is pivotal relative to the work vehicle about a horizontal lift axis such that an elevation of the main housing is adjusted with pivotal movement of the hoist arm about the lift axis, wherein the mounting member is arranged to connect the main housing relative to the hoist arm.

15. The device according to claim 14 wherein the main housing is arranged to be suspended from the hoist arm by the mounting member, the mounting member being flexible such that the main housing can be deflected laterally relative to the work vehicle as the work vehicle is displaced in the forward working direction alongside in the pipe.

16. The device according to claim 14 further comprising a vehicle adapter frame supporting the hoist arm thereon, the vehicle adapter frame including a pair of fork pockets formed therein which are arranged to receive lifting forks of the work vehicle therein so as to support the vehicle adapter frame on the work vehicle.

17. The device according to claim 14 further comprising a vehicle adapter frame arranged to be supported on the work vehicle in which the vehicle adapter frame supports the hoist arm thereon, wherein the hoist arm is arranged to be supported relative to the vehicle adapter frame for pivotal movement about a vertical pivot axis such that the hoist arm is pivotal between a stored position oriented parallel to the forward working direction and a working position oriented to extend forwardly and laterally outwardly at a slope of between 35 and 55 degrees from the forward working direction in the mounted position of the main housing relative to the pipe.

18. The device according to claim 1 wherein said at least one heater comprises a burner arranged to combust a fuel to heat the bounded space.

19. The device according to claim 1 wherein said at least one heater comprises an electric heating element arranged to heat the bounded space.

20. The device according to claim 1 in combination with the pipe, wherein the main housing is fully mounted on the pipe such that the opposing ends of the bounded space are open to the bottom of the main housing at the laterally opposing sides of the pipe.

* * * * *